US007308865B2

(12) United States Patent
Ravarini

(10) Patent No.: US 7,308,865 B2
(45) Date of Patent: Dec. 18, 2007

(54) INSTALLATION FOR THE ELECTROSTATIC OILING OF METAL STRIPS

(75) Inventor: Luigi Ravarini, Milan (IT)

(73) Assignee: Ravarini Castoldi & C.S.R.L. (IT)

( * ) Notice: Subject to any disclaimer, the term of this patent is extended or adjusted under 35 U.S.C. 154(b) by 286 days.

(21) Appl. No.: 10/547,168

(22) PCT Filed: Mar. 31, 2004

(86) PCT No.: PCT/EP2004/003385

§ 371 (c)(1),
(2), (4) Date: Aug. 25, 2005

(87) PCT Pub. No.: WO2004/089553

PCT Pub. Date: Oct. 21, 2004

(65) Prior Publication Data

US 2006/0144329 A1 Jul. 6, 2006

(30) Foreign Application Priority Data

Apr. 8, 2003 (IT) ..... MI2003A0690

(51) Int. Cl.
*B05C 5/04* (2006.01)
*B05D 1/04* (2006.01)

(52) U.S. Cl. ..... 118/50.1; 118/620; 118/621; 118/326

(58) Field of Classification Search ..... 118/50.1, 118/620, 621, 326; 427/458, 483, 485, 486
See application file for complete search history.

(56) References Cited

U.S. PATENT DOCUMENTS

| | | | | |
|---|---|---|---|---|
| 3,511,693 | A | 5/1970 | Davidson | |
| 4,221,185 | A | 9/1980 | Scholes et al. | |
| 4,344,381 | A * | 8/1982 | Ostrowski et al. | 118/626 |
| 4,904,505 | A | 2/1990 | Ison et al. | |

FOREIGN PATENT DOCUMENTS

| | | |
|---|---|---|
| GB | 797 713 | 7/1958 |

* cited by examiner

*Primary Examiner*—Laura Edwards
(74) *Attorney, Agent, or Firm*—Robert W. Becker; Robert W. Becker & Associates

(57) ABSTRACT

An installation for the electrostatic oiling of metal strips, with an integral system for heating the fluid circuits which allows the application of products which are solid at room temperature with melting point of 30-50° C., wherein the main heated components of the installation are constituted by: a container (3) provided with double wall an shell and bottom within which diathermic oil circulates, a heated circulation pump (5); an electrical passage heater (6); heated Duplex filters (7, 13); heated metering pumps (8); heated pipelines (4, 12, 14); a heated booth (20); heated self-priming pump (16).

5 Claims, 5 Drawing Sheets

Heated Double Filter

INSTALLATION FOR THE ELECTROSTATIC OILING OF METAL STRIPS

This specification for the instant application should be granted the priority date of Apr. 8, 2003, the filing date of the corresponding Italian patent application MI2003A000690 as well as the priority date of 31 Mar. 2004, the filing date of the corresponding International patent application PCT/EP2004/003385.

BACKGROUND OF THE INVENTION

In known installations for the electrostatic oiling of metal strips, oils of various natures but in any case liquid at room temperature are applied uniformly onto the surface of the ribbons.

In recent years, the need has emerged to apply known products such as "Hot Melt", "Dry-Lube", "Dry-Film" or similar denominations, whose common feature is that they are solid at room temperature with a melting point of about 30-50° C. This characteristic makes them particularly attractive as lubricants to facilitate sheet metal forming, for instance in the automotive industry.

The object of the present invention is to provide an installation that allows to apply such solid products with the same electrostatic process and the same ease of operation of the installation that are characteristic of conventional liquid products.

BRIEF DESCRIPTION OF THE DRAWINGS

With reference to the drawings, the installation according to the invention with an integral system for heating the fluid circuits is described.

In particular, the figures show.

DESCRIPTION OF SPECIFIC EMBODIMENTS

Figure 1:
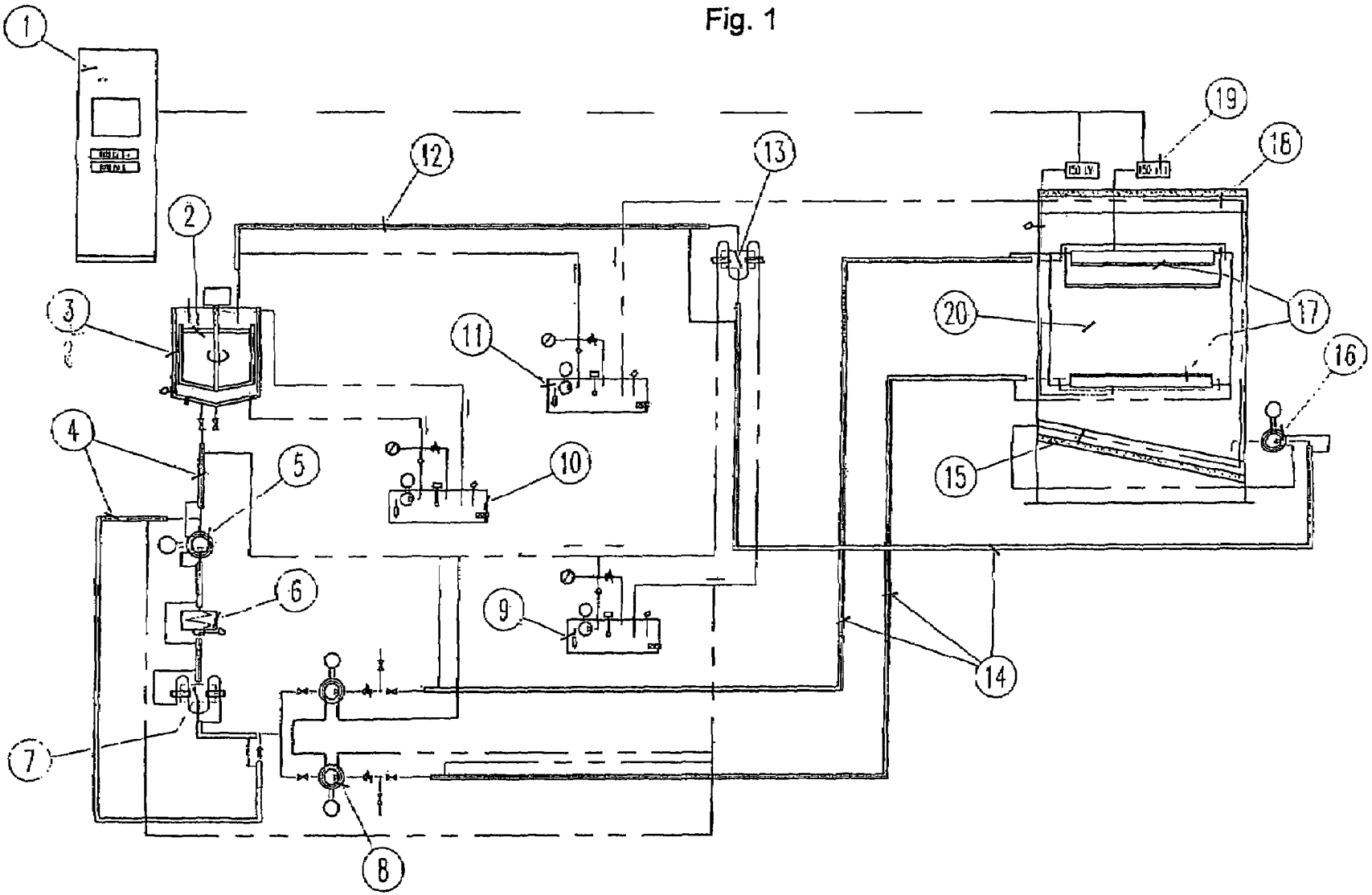
FIG. 1 a global view of the installation according to the invention with the integral system for heating the fluid circuits, FIG. 2 a section of the heated roof and bottom of the oiling booth, FIG. 3 a section of a heated coaxial tube FIG. 4 a heated dual filter FIG. 5 a heated pump
Figure 2:
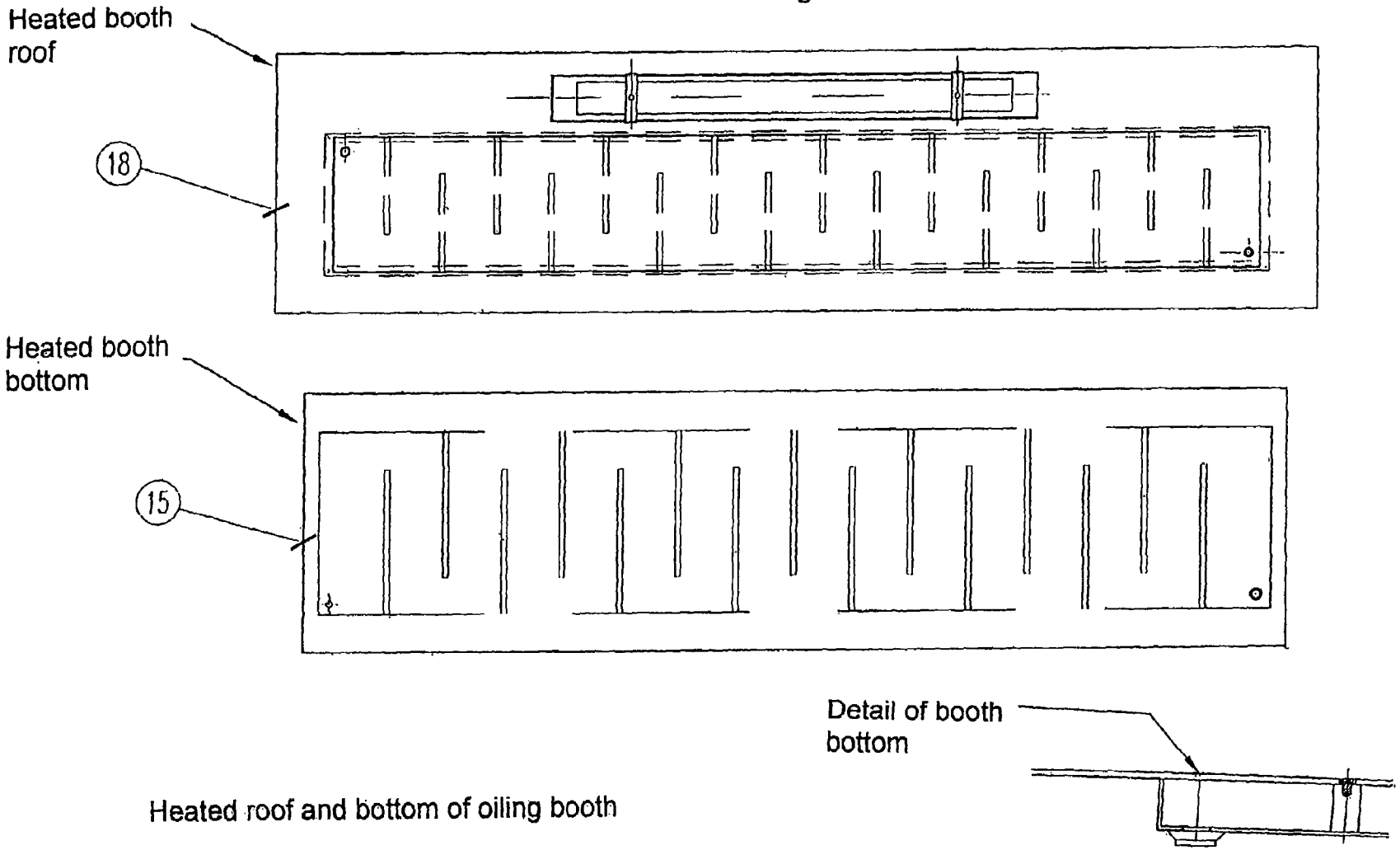

The container (3) must be able to melt the product, bring the whole mass to melting point, and then homogeneously maintain the product at said temperature to avoid partial solidification or stratification of the different components.

In practical embodiments, it is a cylindrical container with vertical axis provided with double wall on shell and conical bottom, within which diathermic oil can be made to circulate. The outer surface with the exception of the lid is provided with thermal insulation, protected by an external jacket made of welded steel.

The container is provided with a mechanical agitator (2) which facilitates melting of the product and ensures its homogeneity, preventing possible stratification and solidification in dead areas.

From the container (3) the melted product reaches by gravity the inlet of a heated circulation pump (5) which makes it circulate in closed loop through an electrical passage heater (6) and a heated Duplex filter (7).

All rigid or flexible pipelines in the circuit (4, 14, 12) are heated.

The two heated metering pumps (8) aspirate the product from the above circuit and send it to the atomizing blades, also through heated pipelines (14).

The metallic body of the blades is heated by internal circulation of diathermic oil at the most appropriate temperature for atomizing the product, but in any case at a temperature exceeding the melting point, as described in Italian Patent No. 1 223 608.

The blades (17) are electrically connected to high voltage sources (19) and, subjected to high electrostatic voltage, they cause the product to be atomized into very minute droplets and to be laid onto the grounded metal strip which slides between them in a horizontal or sometimes vertical plane.

The percentage of the product that is not laid onto the strip (mostly due to the greater width of the blades relative to the strip)—is laid onto the protections of the blades, onto the walls and onto the bottom of the booth (20) where it would cool down and solidify, preventing the regular continuation of the process.

To avoid this, the interior of the booth (20) is heated to a temperature exceeding the melting point of the product, for instance making a diathermic fluid circulate within labyrinth chambers obtained in the bottom (15) and in the roof (18) of the booth itself.

In the meantime walls, bottom and roof of the booth are thermally insulated with rock wool or expanded polymers with closed cells to minimize heat dispersion and energy consumption.

The product thus maintained liquid is collected on the bottom of the booth in a manner that is wholly similar to that of a conventional oil.

On the command of a level sensor, it is aspirated by a heated self-priming pump (16) and, through a heated Duplex filter (13) and a heated pipeline (12), it is pumped back into the container (3) thus making the efficiency of the entire operation very close to one.

Figure 4:
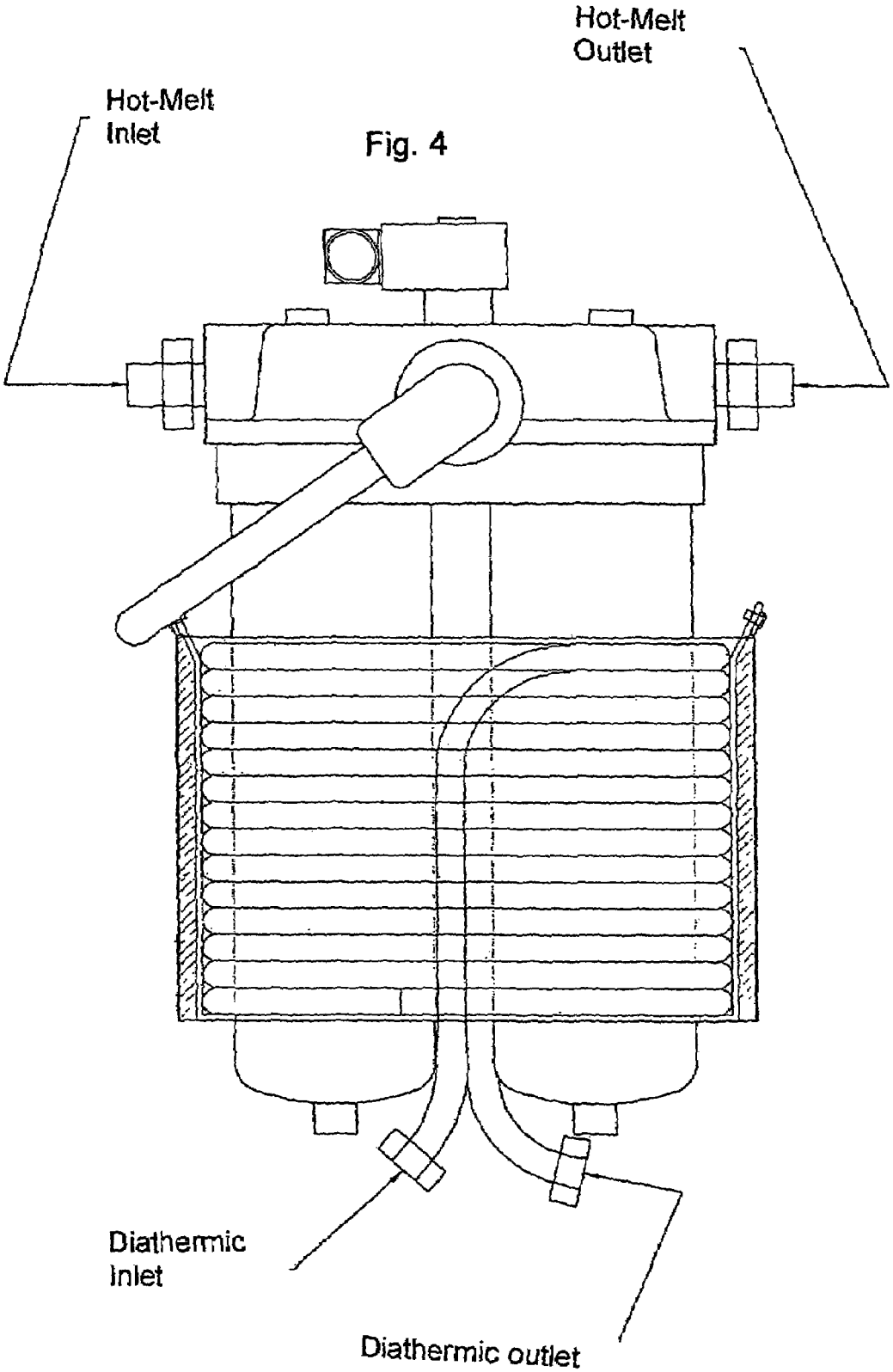
Figure 5:
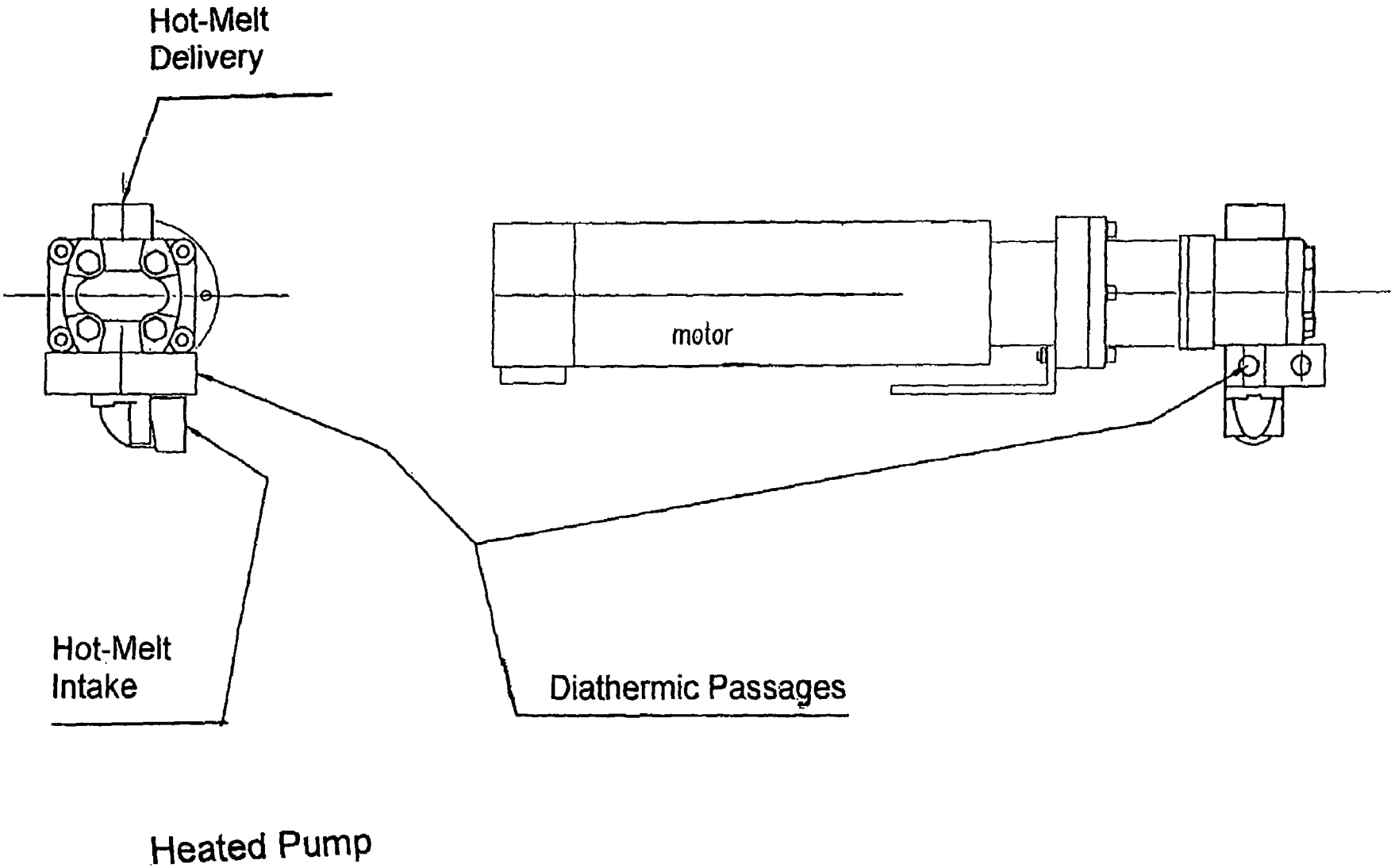

Such a high efficiency is advantageous both to the economy of the process and to the cleanliness and healthiness of the workplace. The filters (7,13), the circulation (5), metering (8) and return pumps (16) are heated by circulating diathermic fluid directly in their body or within the blocks or coils closely adhering thereto (see FIGS. 4-5).

When possible, to these elements too are applied thermally insulating coatings to improve heating efficiency and reduce energy consumption.

All pipeline segments through which the melted product flows must be heated, as stated, to prevent them from cooling and solidifying, especially when the installation is idle.

Figure 3:
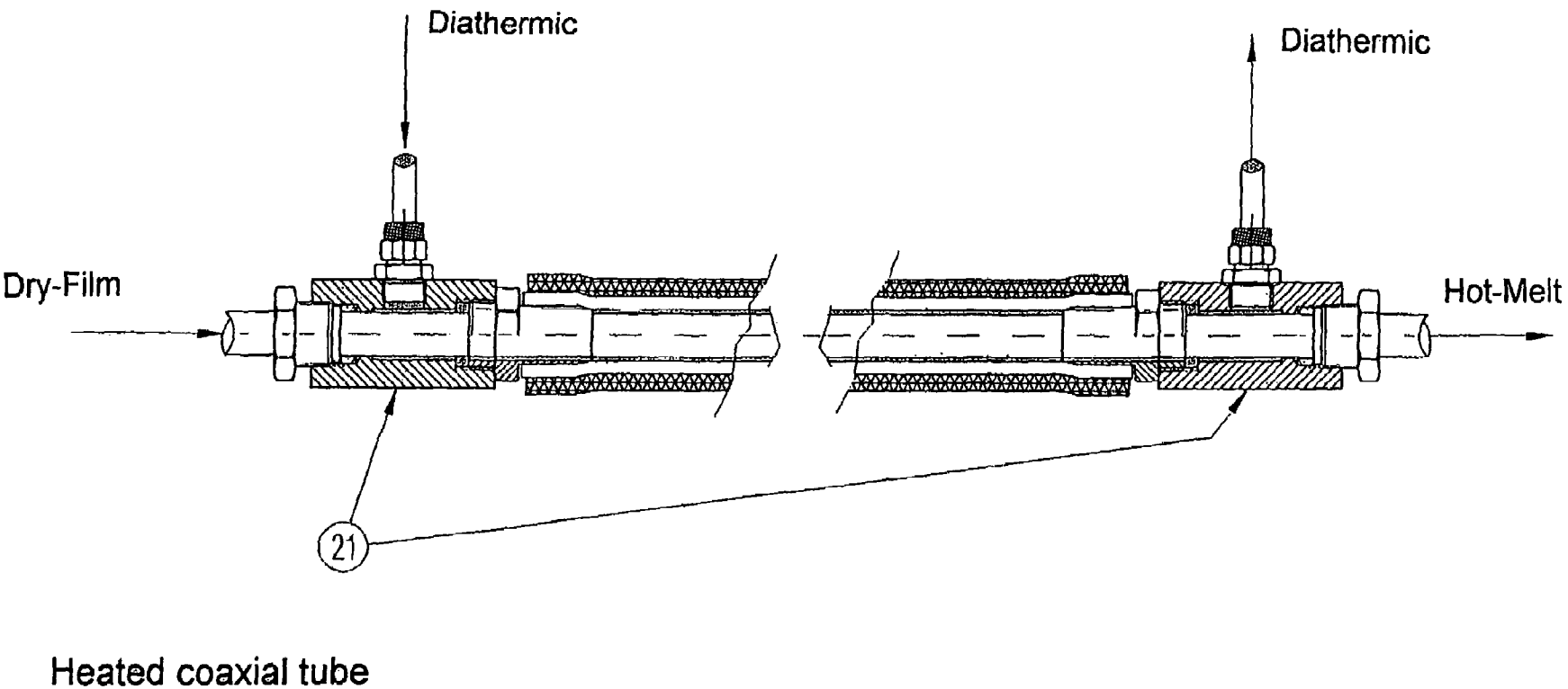

To solve this problem at contained costs and simplified controls, appropriate terminals (21) have been provided (see FIG. 3) which allow to obtain coaxial tubes in which the products flows through the inner tube which is normally made of polyamide resin with or without textile or steel sock reinforcements and related protective outer sheath made of synthetic material.

In the jacket with annular cross section between the inner tube and the outer tube flows instead the hot diathermic fluid.

Externally to the coaxial pipeline is positioned a thermally insulated sleeve made of expanded polymers with closed cells to reduce heat dispersion.

Tube segments externally connect through the terminals (21) the various segments of heating jacket.

A careful arrangement of inner pipelines and heating jackets allows to reduce fluid paths, reducing size and simplifying mounting operations.

Temperature controls are reduced to only the diathermic fluid heating sets (9-10-11), i.e. a few units.

The diathermic fluids are heated, by way of non limiting example—with sets constituted by a metal tank provided with filling and venting cap, visual level indicator, minimum level sensor, heating electrical resistor of adequate power, temperature sensor, external insulation (9,10,11).

A typical oiling machine for "Hot-Melt" uses three such sets, respectively heating the booth (20), the container (3) or the containers, the blades (17).

The filters, pumps and coaxial pipelines are heated exploiting the outgoing and returning flows of the diathermic fluids that heat the main components of the installation.

The control panel (1) controls all the components of the installation and provides the automation of the operating cycle.

The installation according to the invention has the additional advantage that it can be idled for a prolonged interval without particular problems.

When re-started and adequately heated, the installation can return to operation normally without any particular difficulty, in wholly automatic fashion.

The specification incorporates by reference the disclosure of Italian priority document MI2003A000690 filed Apr. 8, 2003 and PCT/EP2004/003385 filed Mar. 31, 2004.

The present invention is, of course, in no way restricted to the specific disclosure of the specification and drawings, but also encompasses any modifications within the scope of the appended claims.

The invention claimed is:

1. A system for electrostatically oiling metal strips, comprising as heated components:

a container for product, wherein said container is provided with a double-walled shell and bottom within which diathermic fluid is adapted to circulate;

a heated circulation pump for receiving product from said container and moving said product on;

an electrical passage heater for product from said circulation pump;

heated Duplex filters for circulating product;

heated pipelines for circulating product;

a heated booth for applying product to metal strips to effect electrostatic oiling thereof;

heated metering pumps for conveying said product to said booth; and a heated, self-priming pump for returning product to said container, wherein said heated components form an integral system that enables application of a product that is solid at room temperature and has a melting point of 30-50° C.

2. A system according to claim 1, wherein said booth is provided with a bottom and a roof that have labyrinth chambers, wherein said bottom, said roof and lateral walls of said booth are provided with thermal insulation, and wherein an interior of said booth, via circulation of a diathermic fluid within said labyrinth chambers, is heated to a temperature that exceeds the melting point of said product.

3. A system according to claim 1, wherein all portions of said pipelines through which melted product flows are heated and thermally insulated.

4. A system according to claim 1, wherein terminals are provided in order to form coaxial pipelines.

5. A system according to claim 1, wherein diathermic fluid heating sets are provided, and wherein temperature controls are provided only for said diathermic fluid heating sets.

* * * * *